US006371796B2

(12) United States Patent
Fukuda

(10) Patent No.: US 6,371,796 B2
(45) Date of Patent: Apr. 16, 2002

(54) WATERPROOF HALF-FITTING DETECTION CONNECTOR WITH WATERPROOF CAP

(75) Inventor: Masaru Fukuda, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/823,764

(22) Filed: Apr. 3, 2001

(30) Foreign Application Priority Data

Apr. 3, 2000 (JP) ..... 12-100892

(51) Int. Cl.[7] ..... H01R 3/00; H01R 13/627; H01R 29/00

(52) U.S. Cl. ..... 439/489; 439/188; 439/354

(58) Field of Search ..... 439/489, 188, 439/521, 350, 490, 587, 189, 354

(56) References Cited

U.S. PATENT DOCUMENTS 5,613,872 A 3/1997 Fukuda et al. ..... 439/489
5,651,693 A 7/1997 Fukuda et al. ..... 439/489
5,997,344 A * 12/1999 Shinozaki ..... 439/489

FOREIGN PATENT DOCUMENTS

JP 7-142122 6/1995 ..... H01R/13/64
JP 9-073954 3/1997 ..... H01R/13/64

* cited by examiner

*Primary Examiner*—Brian Sircus
*Assistant Examiner*—Chandrika Prasad
(74) *Attorney, Agent, or Firm*—Sughrue Mion, PLLC

(57) ABSTRACT

A half-fitting detection connector (21) includes male and female connector housings (23, 26) fittable to each other. A pair of engagement detecting contacts (29, 30) are attachable to a shaft-like portion (40) of the female connector housing (26). An elastically deformable waterproofing cap (32) is attachable onto the shaft-like portion (40) so as to cover the engagement detecting contacts (29, 30) in a hermetically sealed state. When at least one of the engagement detecting contacts (29, 30) is pressed by a pressing portion (43*d*) through the waterproofing cap (32), the engagement detecting contacts (29, 30) are brought into electrical contact with each other by the pressing portion (43*d*), so that a connector fitting state of the male and female connector housings (23, 26) is detected.

4 Claims, 5 Drawing Sheets

WATERPROOF HALF-FITTING DETECTION CONNECTOR WITH WATERPROOF CAP

BACKGROUND OF THE INVENTION

1. Field of the Invention

The present invention relates to a half-fitting detection connector. More particularly, the present invention relates to a structure for waterproofing a half-fitting detection connector which is capable of detecting a state of halfway engagement between a pair of connector housings by detecting the conductivity of a pair of engagement detecting contacts provided at a predetermined position on one connector.

The present application is based on Japanese Patent Application No. 2000-100892, which is incorporated herein by reference.

2. Description of the Related Art

In general, various electronic equipment is mounted in a vehicle such as an automobile, and male and female connectors of various configurations are used for connection between such electronic equipment or the like and a wire harness or the like and for interconnection between various electric wires.

FIGS. 4 and 5 illustrate an example of a half-fitting detection connector which is capable of detecting a half-fitting state by a conductivity check when a pair of connector housings are incompletely fitted (i.e., are in the half-fitting state).

The aforementioned half-fitting detection connector 1 is disclosed in Unexamined Japanese Patent Publication No. Hei. 9-73954 and the like, and is arranged such that, as shown in FIG. 4, when a male connector housing 3 accommodating female-type connection terminals 2 and a female connector housing 6 accommodating male-type connection terminals 5 are fitted and connected to each other, it is possible to detect whether the fitting between the male and female connector housings 3 and 6 is complete or incomplete by detecting the conductivity between a pair of engagement detecting contacts 8 and 9 provided on the female connector housing 6.

As shown in FIG. 5, the pair of engagement detecting contacts 8 and 9 are spaced apart from each other and arranged in parallel, and are resilient terminals whose tip portions 8*a* and 9*a* are elastically displaceable toward a connecting terminal plate 10 fixed to an arm engaging portion 6*a* of the female connector housing 6.

When the male and female connector housings 3 and 6 are fitted to each other, the tip portions 8*a* and 9*a* are displaced toward the connecting terminal plate 10 by a pressing portion 3*b* of a lock arm 3*a* provided on the male connector housing 3. When the male and female connector housings 3 and 6 assume a completely fitted and connected state, both of the pair of engagement detecting contacts 8 and 9 are set in a state of being brought into pressure contact with the connecting terminal plate 10 by the resiliently urging force of the lock arm 3*a*, so that the engagement detecting contacts 8 and 9 assume a mutually conducting and shortcircuited state.

On the other hand, if the fitting between the male and female connector housings 3 and 6 is incomplete, the displacement of the engagement detecting contacts 8 and 9 due to the urging by the lock arm 3*a* is insufficient, and the engagement detecting contacts 8 and 9 remain in a state of noncontact with the connecting terminal plate 10, so that the engagement detecting contacts 8 and 9 do not conduct across them.

Accordingly, as the nonconductivity between the engagement detecting contacts 8 and 9 is detected by an unillustrated electric circuit for detection, the occurrence of half-fitting between the male and female connector housings 3 and 6 can be detected reliably.

As for the connectors used in the connection of the wire harness in a vehicle, it is important to ensure waterproofness for them so that water will not enter the mutually connecting portions of connection terminals within the connector housing even when they are splashed with cleaning water during car washing, rainwater or the like.

In the case of the above-described half-fitting detection connector 1, the waterproofness against the mutually fitting and connecting portions of the connected connection terminals 2 and 5 can be realized relatively easily by, for instance, providing an annular seal member between mutually fitting portions of the male and female connector housings 3 and 6.

However, since the engagement detecting contacts 8 and 9 for the conductivity check and the connecting terminal plate 10 are provided outwardly of the seal member provided between the mutually fitting portions of the male and female connector housings 3 and 6, and since mutual conduction must be ensured, it is difficult to prevent the entry of droplets of water from the outside. Hence, there is the possibility of the half-fitting detecting function becoming impaired by the contamination of the engagement detecting contacts 8 and 9 and the connecting terminal plate 10 due to the water droplets which entered.

SUMMARY OF THE INVENTION

To overcome the above-described drawbacks, it is an object of the present invention to provide a half-fitting detection connector which is capable of ensuring the waterproofness of the mutually connecting portions of the engagement detecting contacts for a conductivity check so as to prevent the half-fitting detecting function from becoming impaired due to the entry of droplets of water.

To achieve the above object, according to a first aspect of the present invention, there is provided a connector which comprises a pair of connector housings fittable to each other, one of which includes a pressing portion; a seal member attachable between fitting portions of the connector housings; an attachment portion; a pair of engagement detecting contacts attachable to the attachment portion; and an elastically deformable waterproofing cap attachable onto the attachment portion so as to cover the engagement detecting contacts in a hermetically sealed state, wherein when at least one of the engagement detecting contacts is pressed by the pressing portion through the waterproofing cap, the engagement detecting contacts are brought into electrical contact with each other by the pressing portion, so that a connector fitting state of the connector housings is detected.

According to a second aspect of the present invention, the attachment portion and the pressing portion may be located outside the fitting portions of the connector housings.

According to a third aspect of the present invention, the connector may further comprises connection terminals insertable into the connector housings to extend in the fitting portions of the connector housings, wherein the connection terminals are electrically connected to each other when the connector housings are fitted to each other.

According to a fourth aspect of the present invention, the other one of the connector housings may include the attachment portion.

In accordance with the above-described construction according to any one of the aspects of the present invention, with respect to mutually contacting portions of the engagement detecting contacts for a conductivity check, the entry of water from the outside is prevented by the waterproofing cap for covering these engagement detecting contacts in a hermetically sealed state. Of course, for example, with respect to mutually fitting and connecting portions of connection terminals accommodated in the connector housings, the entry of water from the outside is also prevented by the seal member provided between the fitting portions of the pair of connector housings.

In accordance with the above-described construction according to any one of the aspects of the present invention, when the connector housings are completely fitted to each other, the pair of engagement detecting contacts are, for example, shortcircuited by the pressing portion. At this time, the pressing portion presses and urges, for example, at least one engagement detecting contact through the elastically deformable waterproofing cap so that the engagement detecting contacts are brought into pressure (electrical) contact with each other.

Therefore, satisfactory waterproofness can be ensured not only for the mutually fitting and connecting portions of the connection terminals accommodated in the respective connector housings but also for the mutually contacting portions of the engagement detecting contacts for the conductivity check. Accordingly, the detection of half-fitting can be effected reliably.

The above and other objects, features and advantages of the present invention will become more apparent from the following detailed description of the present invention when read in conjunction with the accompanying drawings.

DETAILED DESCRIPTION OF THE PREFERRED EMBODIMENT

Referring now to the accompanying drawings, a detailed description will be given of a half-fitting detection connector in accordance with an embodiment of the present invention.

Figure 1:
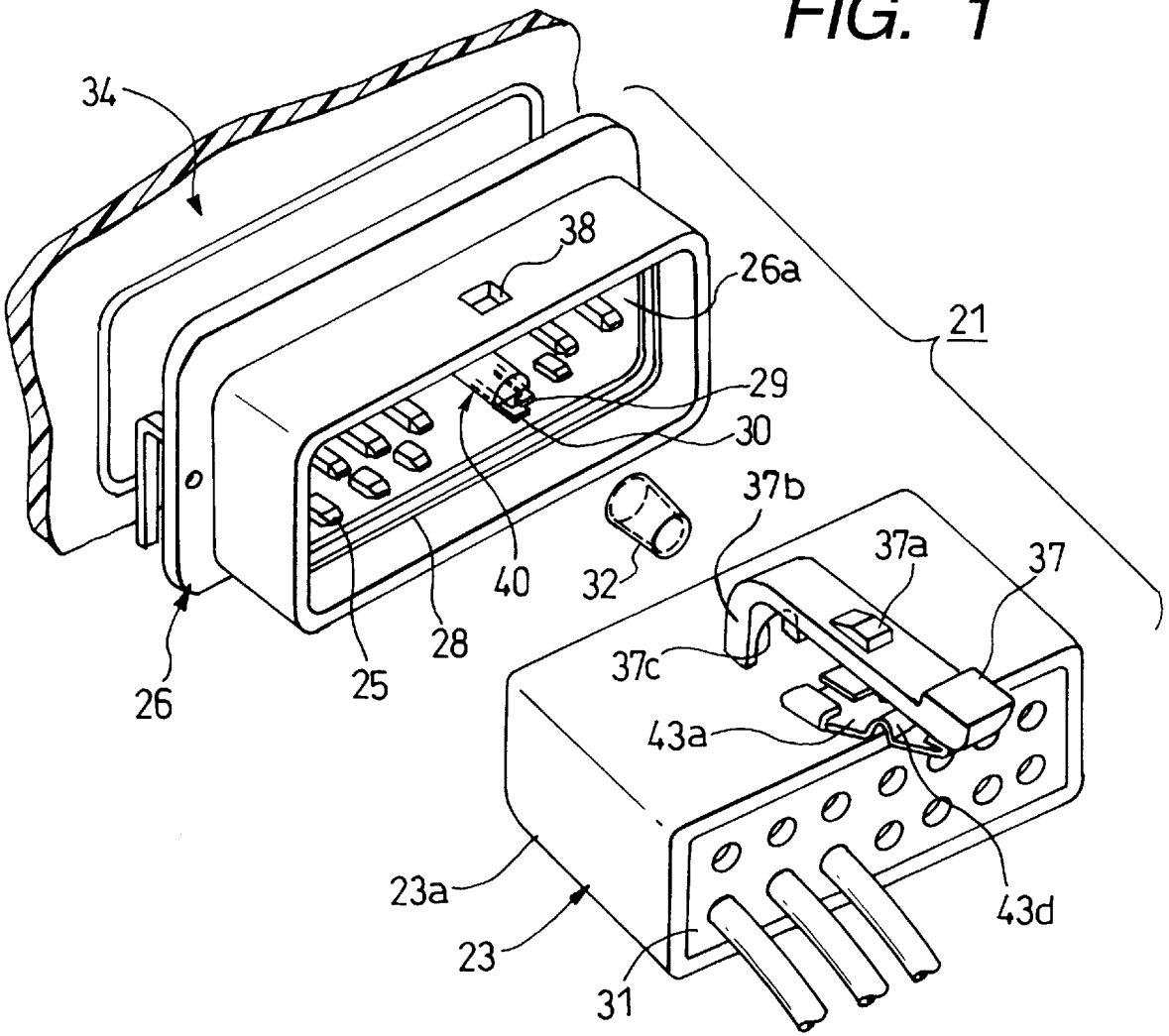
FIG. 1 is an exploded perspective view of a half-fitting detection connector in accordance with an embodiment of the present invention.
Figure 2:
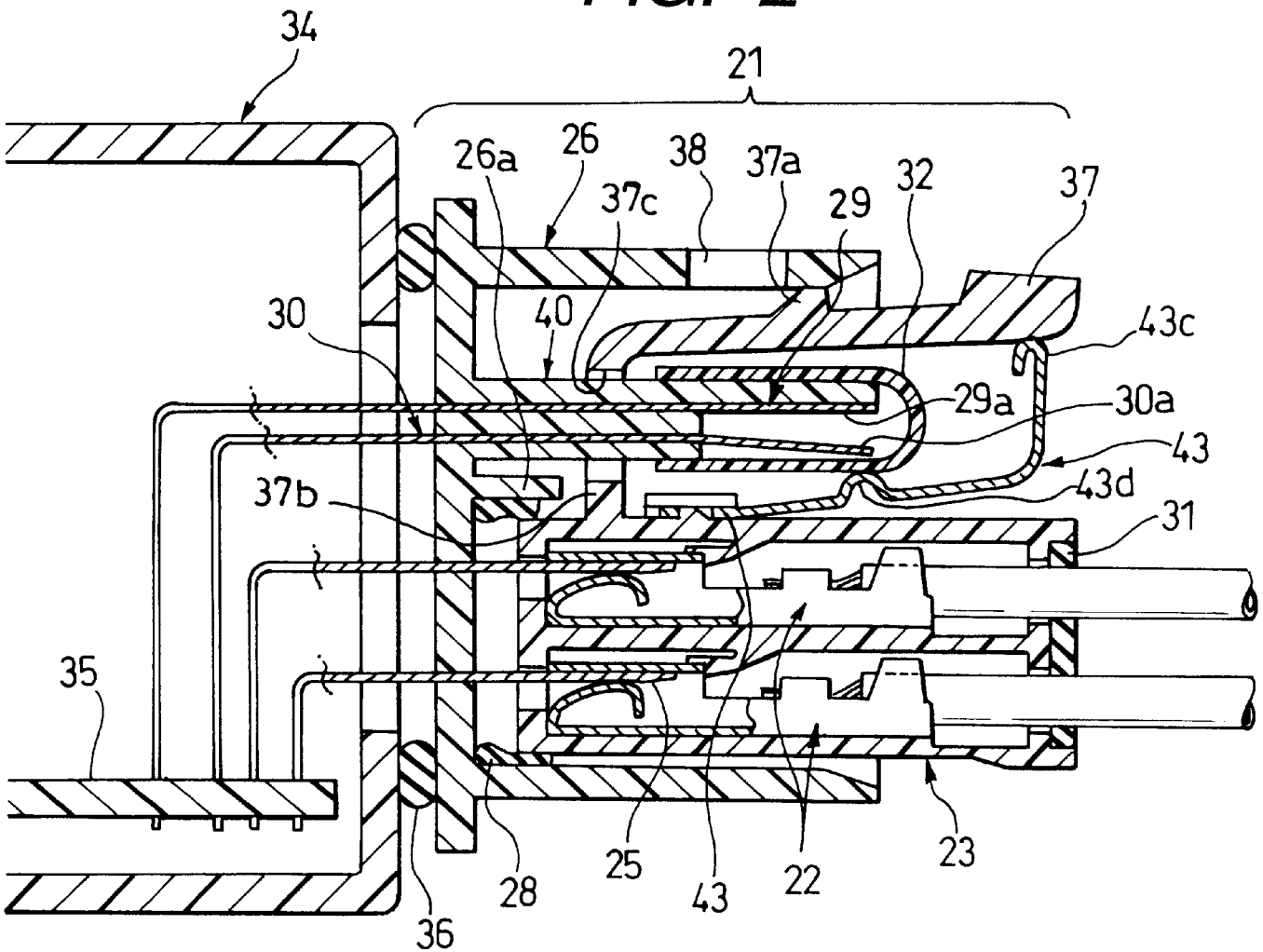
FIG. 2 is a vertical cross-sectional view of the half-fitting detection connector shown in FIG. 1.
Figure 3:
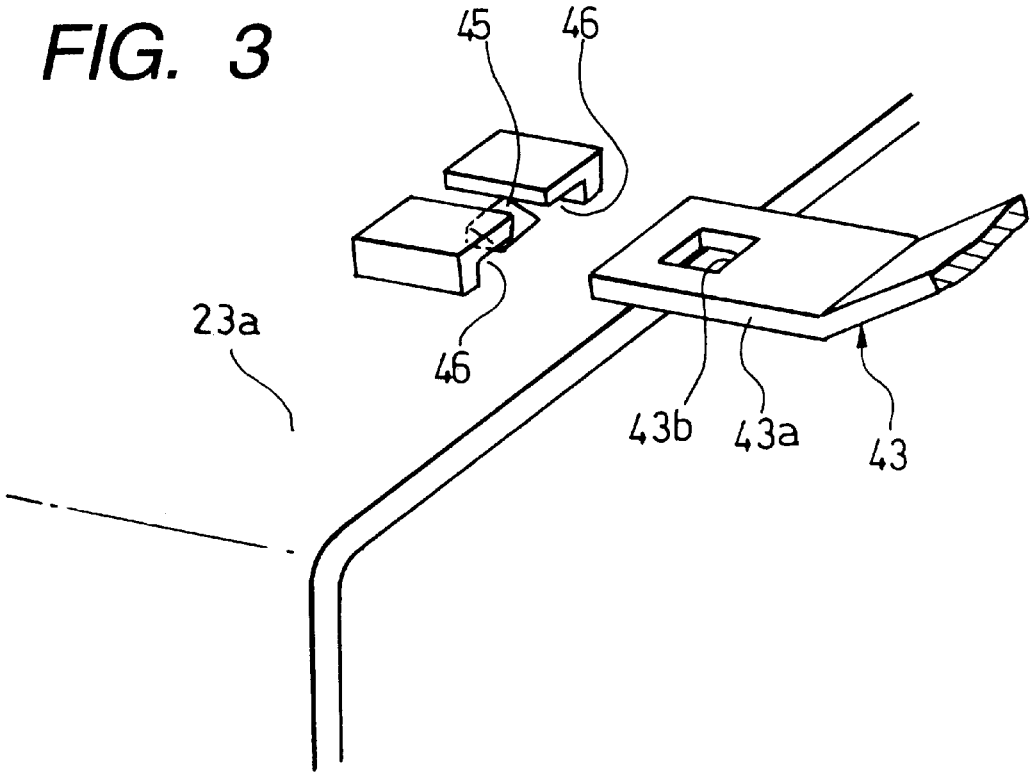
FIG. 3 is a partially enlarged perspective view of the half-fitting detection connector shown in FIG. 1.
Figure 4:
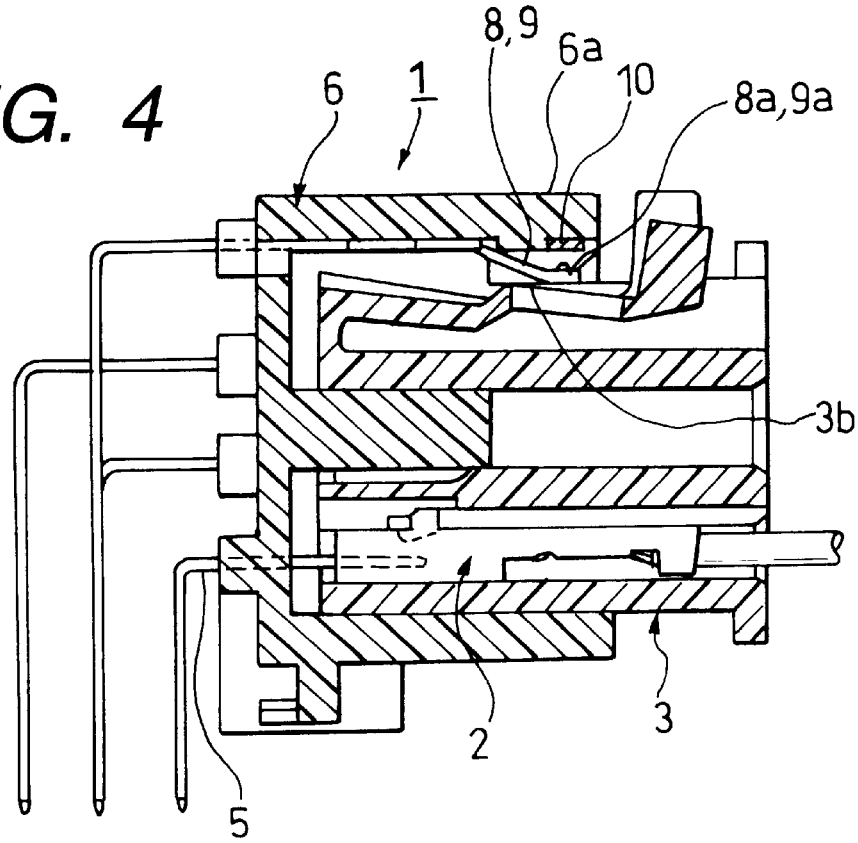
FIG. 4 is a vertical cross-sectional view of a related half-fitting detection connector.
Figure 5:
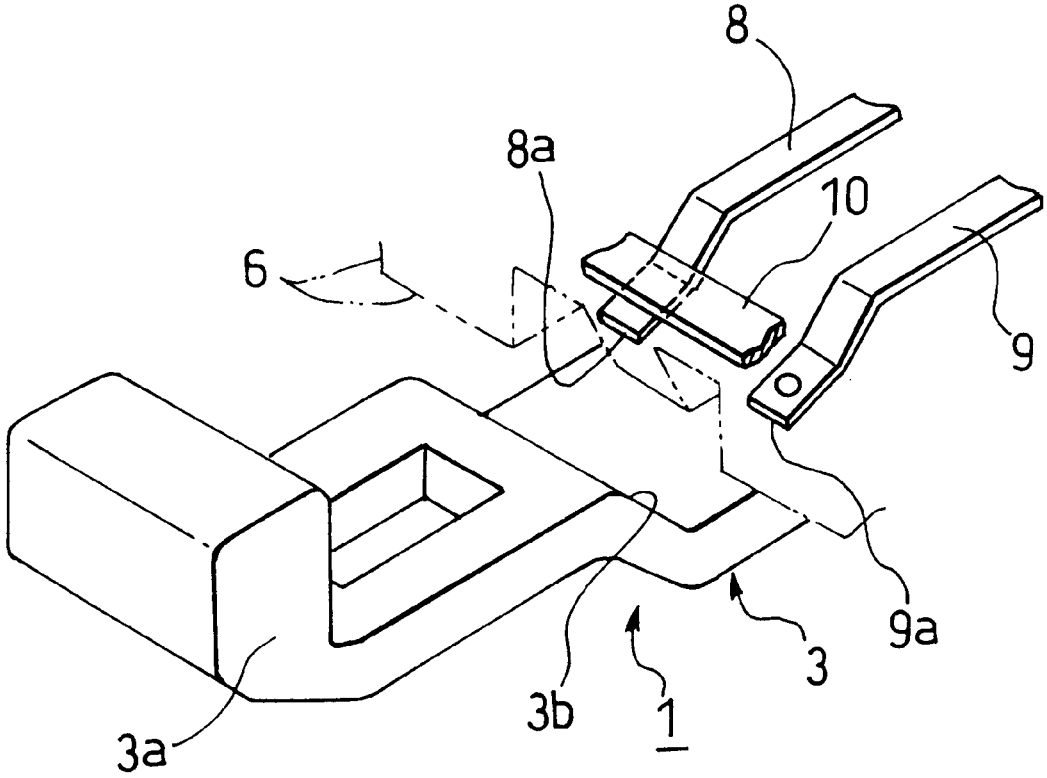
FIG. 5 is an enlarged perspective view of an essential portion of the half-fitting detection connector shown in FIG. 4.
Figure 6:
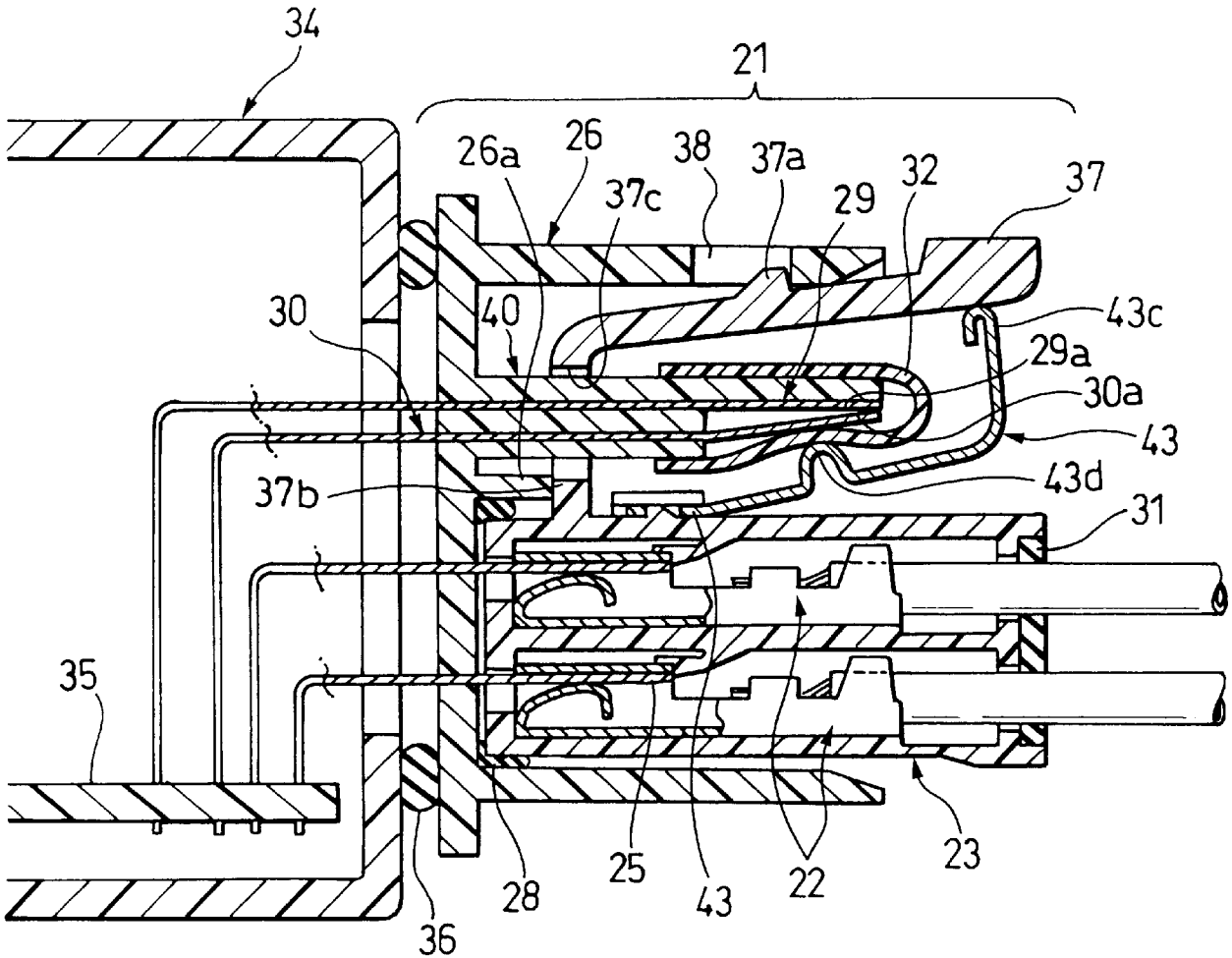
FIG. 6 is a vertical cross-sectional view of the half-fitting detection connector of FIG. 1 shown in a state of full engagement.

FIG. 1 is an exploded perspective view of a half-fitting detection connector in accordance with an embodiment of the present invention;

FIG. 2 is a vertical cross-sectional view of the half-fitting detection connector shown in FIG. 1; and FIG. 3 is a partially enlarged perspective view of the half-fitting detection connector shown in FIG. 1.

As shown in FIGS. 1 and 2, a half-fitting detection connector 21 in this embodiment is comprised of a male connector housing 23 accommodating female-type connection terminals 22; a female connector housing 26 accommodating male-type connection terminals 25 and adapted to be fitted and connected to the male connector housing 23; an annular seal member 28 provided between mutually fitting portions of the pair of male and female connector housings 23 and 26; a pair of engagement detecting contacts 29 and 30 provided in a shaft-like portion 40 which is an attachment portion of the female connector housing 26; and a waterproofing cap 32 for covering the pair of engagement detecting contacts 29 and 30 in a hermetically sealed state.

In the case of this embodiment, the female-type connection terminals 22 accommodated in the male connector housing 23 are crimped and fixed to ends of wires making up a wire harness, while the male-type connection terminals 25 accommodated in the female connector housing 26 extend from a control board 35 disposed in a control unit case 34 (see FIG. 2). The control board 35 has various circuits mounted thereon for controlling the operation of various electric equipment mounted in the vehicle.

Waterproofness is ensured between the female connector housing 26 and the control unit case 34 by a seal member 36 clamped by the two members. In addition, waterproofness is ensured between the wires making up the wire harness and the male connector housing 23 by means of a rubber plug 31.

When the amount of mutual fitting between the pair of male and female connector housings 23 and 26 shown in this embodiment has reached a predetermined value, a retaining projection 37*a* of a lock arm 37 projecting from an outer peripheral surface of the male connector housing 23 engages a retaining hole 38 formed penetratingly in an outer peripheral wall of the female connector housing 26, thereby holding the male and female connector housings 23 and 26 in a locked state. When the male and female connector housings 23 and 26 are set in the locked state, the female-type connection terminals 22 and the male-type connection terminals 25 assume a sufficiently fitted and connected state, and the wire harness assumes a state of being electrically connected to the control board 35 in the control unit case 34.

A terminal accommodating portion 23*a* of the male connector housing 23, in which terminal accommodating holes for accommodating the connection terminals 22 are orderly arranged, is fitted into a terminal accommodating portion 26*a* of the female connector housing 26, in which terminal accommodating holes for accommodating and holding the connection terminals 25 are orderly arranged.

The annular seal member 28 is fitted in the terminal accommodating portion 26*a,* and is brought into close contact with an outer peripheral surface of the terminal accommodating portion 23*a,* sealing the gap between the mutually fitting portions of the male and female connector housings 23 and 26 which are fitted to each other. Therefore, it is possible to prevent the entry of droplets of water from the mutually fitting portions of the male and female connector housings 23 and 26.

The aforementioned pair of engagement detecting contacts 29 and 30 are tongue-shaped terminals extending from the control board 35, and are held in the substantially cylindrical shaft-like portion 40 formed integrally with the female connector housing 26.

This shaft-like portion 40 is provided on the outer side of the terminal accommodating portion 26*a* of the female connector housing 26 in such a manner as to project from a bottom wall along the direction in which the housings are fitted to each other. As shown in FIG. 2, the shaft-like portion 40 is passed through an inserting hole 37*c* formed penetratingly in a rising portion 37*b* of the lock arm 37.

Tip portions 29*a* and 30*a* of the engagement detecting contacts 29 and 30, which are spaced apart from each other and arranged in parallel, are disposed in face-to-face relation to each other in the deflecting direction of the lock arm 37 (in the vertical direction in FIG. 2), and the tip portion 29*a* located on the outer side with respect to the terminal accommodating portion 26*a* is fixed to and supported by the shaft-like portion 40. Meanwhile, the tip portion 30*a* located on the inner side with respect to the terminal accommodating portion 26*a* is supported in such a manner as to be capable of being brought into pressure contact with the tip portion 29*a* by undergoing elastic deformation toward the tip portion 29*a*.

The waterproofing cap 32 is an elastically deformable cap which is fitted over the tip of the shaft-like portion 40 so as to cover the engagement detecting contacts 29 and 30 in a hermetically sealed state.

The aforementioned male connector housing 23 is loaded with a shortcircuiting spring member 43 which undergoes elastic deformation in correspondence with the flexural displacement of the lock arm 37 when the male and female connector housings are fitted to each other.

As shown in FIG. 3, the shortcircuiting spring member 43 is fixed to the male connector housing 23 as both side edges of its proximal end portion 43*a* are fitted in a pair of guide grooves 46 provided on an outer peripheral surface of the terminal accommodating portion 23*a*, and a retaining hole 43*b* of the proximal end portion 43*a* is engaged with an engaging projection 45 provided projectingly on the outer peripheral surface of the terminal accommodating portion 23*a*.

A distal end portion 43*c* of this shortcircuiting spring member 43 abuts against a swinging end portion of the lock arm 37, and the shortcircuiting spring member 43 also undergoes elastic deformation in correspondence with the flexural displacement of the lock arm 37.

A pressing portion 43*d* which is displaced in correspondence with the flexural displacement of the lock arm 37 is formed in an intermediate portion of the shortcircuiting spring member 43.

Namely, when the male and female connector housings 23 and 26 are set in a completely fitted state, and the retaining projection 37*a* of the lock arm 37 is fitted in the retaining hole 38 of the female connector housing 26, the aforementioned pressing portion 43*d* follows the displacement of the lock arm 37 (upward displacement in FIG. 2), and presses and urges the tip portion 30*a* in the waterproofing cap 32 toward the tip portion 29*a*.

At this juncture, the pressing portion 43*d* presses and urges the tip portion 30*a* through the waterproofing cap 32, but since the waterproofing cap 32 is formed of an elastically deformable material such as a rubber material, no hindrance is caused to the pressing and urging of the pressing portion 43*d* against the tip portion 30*a*.

Accordingly, the tip portions 29*a* and 30*a* of the engagement detecting contacts 29 and 30 are set in a state of being brought into pressure contact with each other, allowing the engagement detecting contacts 29 and 30 to be shortcircuited.

On the other hand, when the male and female connector housings 23 and 26 are incompletely fitted (i.e., are in a half-fitting state), as shown in FIG. 2, the lock arm 37 is in a state of being deflected downward in FIG. 2, and the shortcircuiting spring member 43 which follows the displacement of the lock arm 37 is also deflected downward. Therefore, since the pressing portion 43*d* does not press and urge the tip portion 30*a* toward the tip portion 29*a*, these engagement detecting contacts 29 and 30 do not contact each other.

Accordingly, by detecting the presence or absence of the conductivity between the engagement detecting contacts 29 and 30 by an unillustrated electrical circuit for detection, it is possible to detect whether the mutually fitted state of the male and female connector housings 23 and 26 is a completely fitted state or a half-fitting state.

Hence, it is possible to improve efficiency in the assembling operation by the elimination of a checking operation by such as visual confirmation during the connector fitting operation.

Namely, according to the half-fitting detection connector 21 in the above-described embodiment, as for the mutually fitting and connecting portions of the connection terminals 22 and 25 accommodated in the male and female connector housings 23 and 26, the entry of water from the outside is prevented by the seal member 28 provided between the fitting portions of the terminal accommodating portions 23*a* and 26*a* in the male and female connector housings 23 and 26.

In addition, as for the tip portions 29*a* and 30*a* which are the mutually contacting portions of the engagement detecting contacts 29 and 30 for the conductivity check, the entry of water from the outside is prevented by the waterproofing cap 32 for covering these tip portions 29*a* and 30*a* in a hermetically sealed state.

Furthermore, when the male and female connector housings 23 and 26 are completely fitted to each other, the pair of engagement detecting contacts 29 and 30 are shortcircuited as the pressing portion 43*d* of the shortcircuiting spring member 43, which is a pressing portion of the male connector housing 23, presses and urges the tip portion 30*a* through the elastically deformable waterproofing cap 32 so that the tip portions 29*a* and 30*a* of the engagement detecting contacts 29 and 30 are brought into pressure contact with each other.

Accordingly, satisfactory waterproofness can be ensured not only for the mutually fitting and connecting portions of the connection terminals 22 and 25 accommodated in the male and female connector housings 23 and 26 but also for the mutually contacting portions of the engagement detecting contacts 29 and 30 for the conductivity check.

Hence, the half-fitting detecting function is not hampered by the entry of water, and the detection of half-fitting can be effected reliably.

It should be noted that the arrangements of the connector housings, the seal members, the engagement detecting contacts, the attachment portion, the waterproofing cap, and the like in the half-fitting detection connector in the present invention are not limited to the arrangements of the above-described embodiment, and it goes without saying that various forms may be adopted in accordance with the gist of the present invention.

For example, although in the above-described embodiment the pair of engagement detecting contacts are provided on the female connector housing side, the engagement detecting contacts may be provided on the male connector housing side.

In addition, in the above-described embodiment, the pressing portion for pressing and urging one engagement detecting contact so as to set the pair of engagement detecting contacts in the shortcircuited state when the connector housings are completely fitted to each other is formed in the shortcircuiting spring member 43 fixed to the male connector housing 23 so as to be elastically displaced by following the lock arm 37, but the present invention is not limited to the same.

For example, the pressing portion may be formed by projectingly forming an engaging projection on an outer peripheral surface of the male connector housing 23 by integral molding or the like, such that when the amount of fitting between the connectors has reached a predetermined value, the engaging projection presses and urges one engagement detecting contact so as to set the pair of engagement detecting contacts in the shortcircuited state.

What is claimed is:

1. A connector, comprising:

a pair of connector housings fittable to each other, one of which includes a pressing portion;

a seal member attachable between fitting portions of the connector housings;

an attachment portion;

a pair of engagement detecting contacts attachable to the attachment portion; and an elastically deformable waterproofing cap attachable onto the attachment portion so as to cover the engagement detecting contacts in a hermetically sealed state, wherein when at least one of the engagement detecting contacts is pressed by the pressing portion through the waterproofing cap, the engagement detecting contacts are brought into electrical contact with each other by the pressing portion, so that a connector fitting state of the connector housings is detected.

2. The connector of claim 1, wherein the attachment portion and the pressing portion are located outside the fitting portions of the connector housings.

3. The connector of claim 1, further comprising connection terminals insertable into the connector housings to extend in the fitting portions of the connector housings, wherein the connection terminals are electrically connected to each other when the connector housings are fitted to each other.

4. The connector of claim 1, wherein the other one of the connector housings includes the attachment portion.

* * * * *